US012693066B2

(12) United States Patent
Park et al.

(10) Patent No.: US 12,693,066 B2
(45) Date of Patent: Jul. 28, 2026

(54) REFRIGERATOR

(71) Applicant: SAMSUNG ELECTRONICS CO., LTD., Suwon-si (KR)

(72) Inventors: Sungcheul Park, Suwon-si (KR); Yonghyun Kang, Suwon-si (KR); Hyoseok Noh, Suwon-si (KR); Changhun Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 53 days.

(21) Appl. No.: 18/676,034

(22) Filed: May 28, 2024

(65) Prior Publication Data

US 2024/0310111 A1 Sep. 19, 2024

Related U.S. Application Data

(63) Continuation of application No. PCT/KR2022/019660, filed on Dec. 6, 2022.

(30) Foreign Application Priority Data

Jan. 27, 2022 (KR) ..... 10-2022-0012689

(51) Int. Cl.
*F25D 23/06* (2006.01)
*F25D 21/04* (2006.01)

(52) U.S. Cl.
CPC ..... *F25D 23/063* (2013.01); *F25D 21/04* (2013.01); *F25D 23/065* (2013.01)

(58) Field of Classification Search
CPC .... F25D 23/063; F25D 23/065; F25D 23/066; F25D 21/04
See application file for complete search history.

(56) References Cited

U.S. PATENT DOCUMENTS 4,114,065 A * 9/1978 Horvay ..... F25D 23/061 62/298
4,903,858 A * 2/1990 Clark ..... F25D 23/064 62/277

(Continued)

FOREIGN PATENT DOCUMENTS

CN 201322500 Y 10/2009
CN 201463456 U 5/2010

(Continued)

OTHER PUBLICATIONS

Supplementary European Search Report dated Jan. 28, 2025 issued in European Application No. EP 22 92 4368.

(Continued)

*Primary Examiner* — Andrew Roersma
(74) *Attorney, Agent, or Firm* — STAAS & HALSEY LLP

(57) ABSTRACT

A refrigerator includes a main body including an inner case including plates each formed by injection molding, an outer case coupled to the inner case. At least one of plates include a front flange forming a front surface of the at least one plate and coupled to the outer case, the outer case includes an insertion groove into which the front flange is inserted. The front flange includes locking ribs arranged to prevent the front flange from moving in a direction opposite to an insertion direction of the front flange based on inserting the front flange into the insertion groove, the locking ribs are injection molded integrally with the at least one plate and protrude from the front flange so as to be locked on the outer case. The locking ribs are spaced apart from each other along a longitudinal direction of the front flange.

13 Claims, 14 Drawing Sheets

(56) References Cited

U.S. PATENT DOCUMENTS

| | | | | |
|---|---|---|---|---|
| 9,970,701 | B2 * | 5/2018 | Cho | F25D 21/04 |
| 10,429,121 | B2 * | 10/2019 | Yoon | F25D 21/04 |
| 10,808,989 | B2 * | 10/2020 | Yoon | F25D 27/00 |
| 10,914,514 | B1 * | 2/2021 | Hunter | F25D 23/066 |
| 11,274,873 | B2 * | 3/2022 | Stahl | F25D 11/00 |
| 11,340,008 | B1 * | 5/2022 | Hunter | F25D 23/066 |
| 12,173,957 | B2 * | 12/2024 | Park | F25D 23/028 |
| 2012/0313497 | A1 * | 12/2012 | Jang | F25D 23/069 312/401 |
| 2017/0108266 | A1 | 4/2017 | Kim et al. | |
| 2018/0187961 | A1 * | 7/2018 | Lim | F25D 27/00 |
| 2018/0259244 | A1 | 9/2018 | Kim et al. | |
| 2022/0341656 | A1 | 10/2022 | Betz et al. | |
| 2023/0258391 | A1 | 8/2023 | Park et al. | |

FOREIGN PATENT DOCUMENTS

| | | | | | |
|---|---|---|---|---|---|
| CN | 101839609 | A | | 9/2010 | |
| CN | 111288735 | A | * | 6/2020 | F25D 23/065 |
| CN | 212902196 | U | | 4/2021 | |
| DE | 10 2005 002 147 | A1 | | 7/2006 | |
| DE | 102015203147 | A1 | * | 8/2016 | F25D 23/061 |
| DE | 102017214709 | A1 | * | 2/2019 | F25D 23/066 |
| EP | 3447418 | A1 | * | 2/2019 | F25D 23/068 |
| EP | 3760954 | A1 | * | 1/2021 | F25D 23/062 |
| JP | 52-157056 | | | 11/1977 | |
| JP | 55-46188 | | | 3/1980 | |
| JP | 3164846 | | | 5/2001 | |
| JP | 2009-222241 | | | 10/2009 | |
| JP | 3209759 | | | 4/2017 | |
| JP | 6788726 | B2 | * | 11/2020 | |
| JP | 6857227 | | | 4/2021 | |
| KR | 0122415 | | | 5/1998 | |
| KR | 1999-0020172 | | | 6/1999 | |
| KR | 20-1999-0027584 | | | 7/1999 | |
| KR | 20-2000-0008591 | | | 5/2000 | |
| KR | 10-0389646 | | | 8/2003 | |
| KR | 10-2005-0034479 | | | 4/2005 | |
| KR | 10-2006-0062063 | | | 6/2006 | |
| KR | 10-1042914 | | | 6/2011 | |
| KR | 10-1519135 | | | 5/2015 | |
| KR | 10-2018-0103555 | | | 9/2018 | |
| KR | 102030846 | B1 | * | 10/2019 | F25D 23/067 |
| KR | 10-2243486 | | | 4/2021 | |
| KR | 10-2022-0085720 | | | 6/2022 | |
| WO | WO 2021/043575 | A1 | | 3/2021 | |

OTHER PUBLICATIONS

International Search Report dated Mar. 30, 2023 issued in PCT Application No. PCT/KR2022/019660.

Written Opinion dated Mar. 30, 2023 issued in PCT Application No. PCT/KR2022/019660.

Office Action dated Sep. 30, 2025, issued in European Application No. 22 924 368.8.

* cited by examiner

REFRIGERATOR

CROSS REFERENCE TO THE RELATED APPLICATION

This application is a continuation application, filed under 35 U.S.C. § 111(a), of International Application PCT/KR2022/019660 filed Dec. 6, 2022, and is based on and claims priority under 35 U.S.C. § 119 to Korean Patent Applications No. 10-2022-0012689, filed on Jan. 27, 2022 in the Korean Intellectual Property Office, the disclosures of which are incorporated by reference herein in their entireties.

TECHNICAL FIELD

The present disclosure relates to a refrigerator, and more particularly, to a refrigerator in which an inner case is formed by assembling a plurality of plates formed by injection molding.

BACKGROUND ART

In general, a refrigerator, an appliance for keeping food fresh, includes a main body having a storage compartment and a cold air supply device for supplying cold air to the storage compartment. The storage compartment includes a refrigerating compartment in which the food is kept refrigerated at a temperature of approximately 0° C. to 5° C., and a freezing compartment in which the food is kept frozen at a temperature of approximately 0° C. to −30° C.

The main body of a refrigerator is formed by the combination of an inner case and an outer case. The inner case forms a storage compartment, and the outer case forms an exterior of the refrigerator. An insulation is placed between the inner and outer cases to provide thermal insulation.

Typically, the inner case of a refrigerator is formed by a vacuum forming method. In other words, the inner case is formed by heating a resin plate, placing the plate stretched by heating on a mold, and drawing air from an opposite side of the mold. Such a vacuum forming method has limitations in accurately processing the shape of the inner case, and thus, it is difficult to form a structure for coupling the inner case to surrounding components.

DISCLOSURE

Technical Problem

One aspect of the present disclosure provides a refrigerator having an inner case formed by assembling a plurality of plates formed by injection molding.

One aspect of the present disclosure provides a refrigerator in which the coupling force of an inner case and an outer case is improved to prevent a gap or step between the inner case and the outer case from occurring.

Technical Solution

According to an embodiment of the present disclosure, a refrigerator includes a main body including an inner case forming a storage compartment having an open front, the inner case including a plurality of plates each formed by injection molding, and an outer case coupled to an outer side of the inner case, an insulation disposed between the inner case and the outer case, and a door coupled to the main body to open or close the storage compartment, wherein at least one of the plurality of plates includes a front flange forming a front surface of the at least one plate and coupled to the outer case, the outer case includes an insertion groove into which the front flange is inserted, the front flange includes a plurality of locking ribs arranged to prevent the front flange from moving in a direction opposite to an insertion direction of the front flange based on inserting the front flange into the insertion groove, the plurality of locking ribs are injection molded integrally with the at least one plate, and the plurality of locking ribs protrude from the front flange so as to be locked on the outer case, and are spaced apart from each other along a longitudinal direction of the front flange.

The plurality of locking ribs may be formed in corner areas adjacent to both ends of the front flange in the longitudinal direction, excluding a central area of the front flange.

The plurality of locking ribs may include a locking surface formed to lock the outer case, and the locking surface may be inclined to extend forwardly in the insertion direction.

The front flange may include a base exposed forwardly to form a portion of a front surface of the main body, and an insertion portion extending from the base to be inserted into the insertion groove, the plurality of locking ribs may be formed to protrude forwardly from the insertion portion.

The refrigerator may further include a hot pipe through which a hot refrigerant passes, wherein the front flange may include a mounting groove formed along the longitudinal direction of the front flange to mount the hot pipe to the mounting groove, and the plurality of locking ribs may be formed adjacent to one side of the mounting groove.

The plurality of locking ribs may include an outer locking rib formed on an outside of the mounting groove.

The plurality of locking ribs may include an extended locking rib extending between an outside of the mounting groove and an inside of the mounting groove.

The front flange may include an expansion area in which a width of the mounting groove gradually widens toward one end of the front flange in the longitudinal direction.

Of the extended locking rib and the outer locking rib, the extended locking rib may be located closer to one end of the front flange.

The plurality of locking ribs may be spaced apart from the hot pipe.

The refrigerator may further include a plurality of support ribs formed within the mounting groove to support the hot pipe.

The plurality of locking ribs may be formed separately from the plurality of support ribs and are spaced apart from the plurality of support ribs.

The plurality of support ribs may include a bottom support rib formed on a bottom surface of the mounting groove and a side support rib formed on a side surface of the mounting groove.

The front flange may include a groove forming portion protruding rearwardly to form a mounting groove, and a reinforcing rib disposed on a rear surface of the front flange to be connected to the groove forming portion.

The reinforcing rib may be formed in corner areas adjacent to both ends of the front flange, excluding a central area of the front flange.

According to an embodiment of the present disclosure, a refrigerator includes a main body including an inner case forming a storage compartment with an open front side and including a plurality of plates each formed by injection molding, an outer case coupled to an outer side of the inner case, and an insulation disposed between the inner case and the outer case, a door coupled to the main body to open or close the storage compartment, and a hot pipe through which a hot refrigerant passes, wherein at least one of the plurality of plates includes a front flange forming a front surface of the at least one plate and coupled to the outer case, the outer case includes an insertion groove into which the front flange is inserted, wherein the front flange includes a plurality of locking ribs arranged to prevent the front flange from moving in a direction opposite to an insertion direction of the front flange in a state in which the front flange is inserted into the insertion groove, and a plurality of support ribs arranged separately from the plurality of locking ribs and formed within a mounting groove to support the hot pipe.

The plurality of locking ribs and the plurality of support ribs may be injection molded integrally with the at least one plate.

The plurality of locking ribs may include an outer locking rib formed outside the mounting groove and an extended locking rib extending between the outside of the mounting groove and the inside of the mounting groove.

The front flange may include a groove forming portion protruding rearwardly to form the mounting groove, and a reinforcing rib disposed on a rear surface of the front flange to be connected to the groove forming portion.

Advantageous Effects

According to various embodiments of the present disclosure, the inner case of the refrigerator may be formed by assembling the plurality of plates formed by injection molding.

According to various embodiment of the present disclosure, the gap or step between the front flange of the inner case and the front portion of the outer case may be prevented from occurring.

MODES OF THE INVENTION

Various embodiments of the present document and terms used therein are not intended to limit the technical features described in this document to specific embodiments, and should be understood to include various modifications, equivalents, or substitutes of the corresponding embodiments.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, figures, steps, operations, elements, components, or combinations thereof, but do not preclude the presence or addition of one or more of the features, figures, steps, operations, elements, components, or combinations thereof.

It will be understood that, although the terms "first", "second", "primary", "secondary", etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items. The expression "at least one of A, B and C" may include any of the following: A, B, C, A and B, A and C, B and C, A and B and C.

Hereinafter, various embodiments according to the disclosure will be described in detail with reference to the accompanying drawings.

Figure 1:
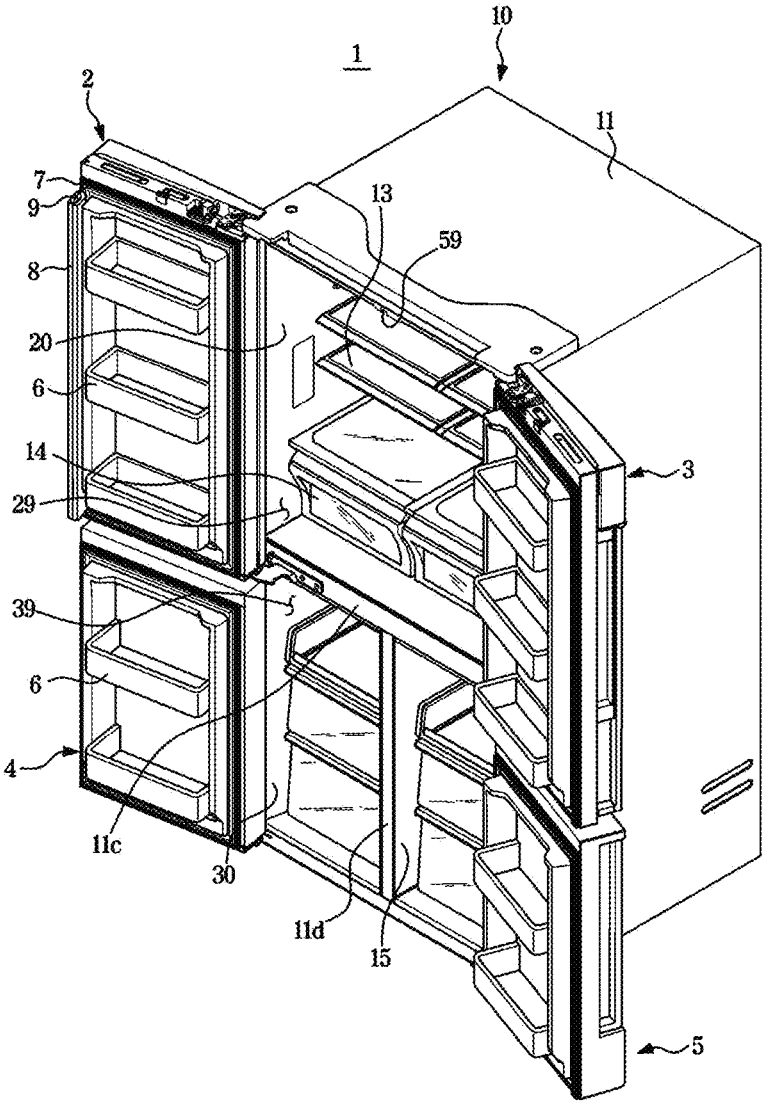
FIG. 1 is a view illustrating an exterior of a refrigerator according to an embodiment of the present disclosure.
Figure 2:
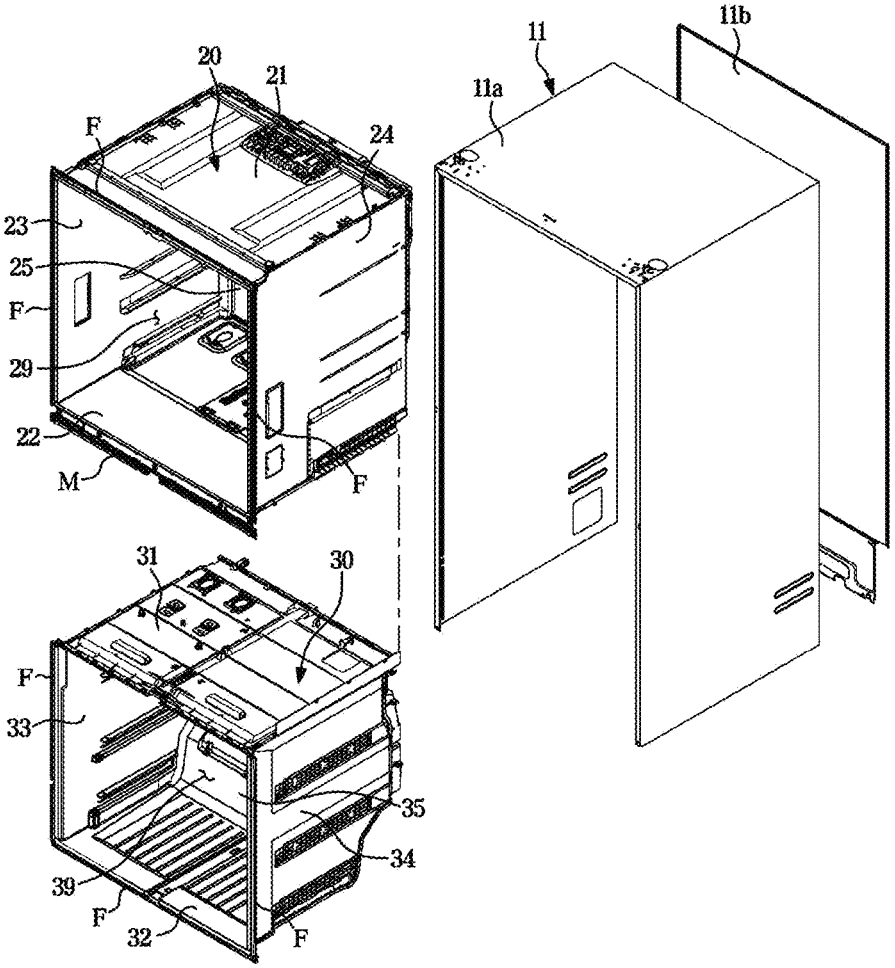
FIG. 2 is a view illustrating a first inner case, a second inner case, and an outer case disassembled according to an embodiment of the present disclosure.
Figure 3:
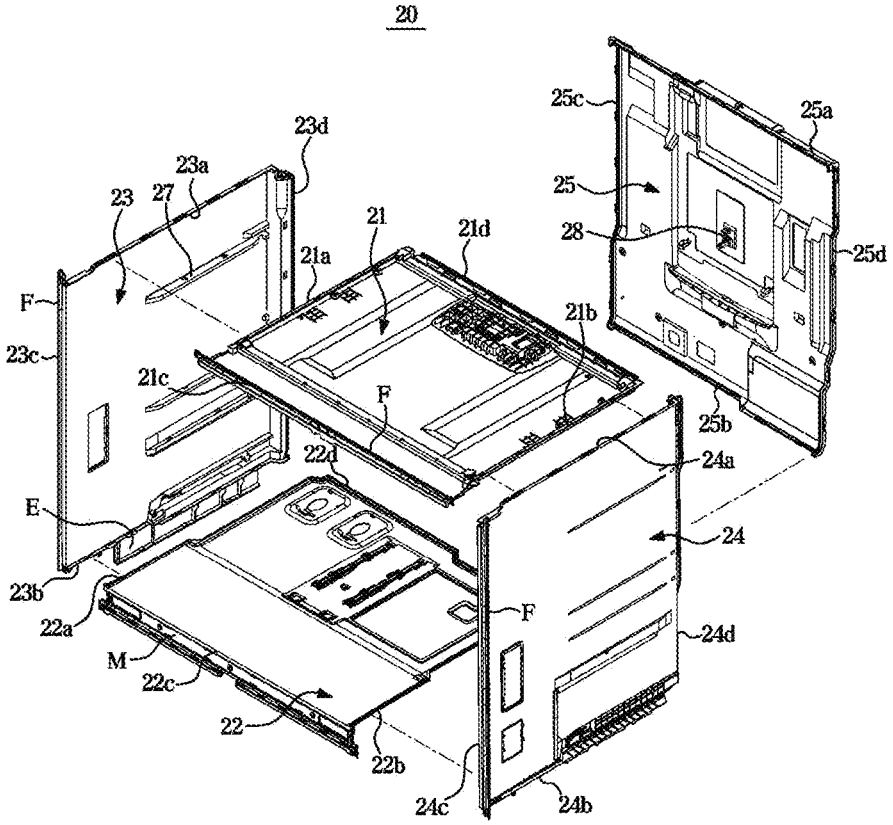
FIG. 3 is a view of the first inner case disassembled, according to an embodiment of the present disclosure.

FIG. 1 is a view showing an exterior of a refrigerator according to an embodiment of the present disclosure. FIG. 2 is an exploded view showing a first inner case, a second inner case, and an outer case of the refrigerator according to an embodiment of the present disclosure. FIG. 3 is an exploded view showing the first inner case according to an embodiment of the present disclosure.

Referring to FIGS. 1 to 3, a refrigerator 1 may include a main body 10, storage compartments 29 and 39 formed within the main body 10, and doors 2, 3, 4, and 5 that open or close the storage compartments 29 and 39, and a cold air supply device (not shown) that supplies cold air to the storage compartments 29 and 39.

The main body 10 may include inner cases 20 and 30 forming the storage compartments 29 and 39, an outer case 11 coupled to an outer side of the inner cases 20 and 30 to form an exterior thereof, and an insulation 12 (see FIG. 12) arranged between the inner cases 20 and 30 and the outer case 11 to thermally insulate the storage compartments 29 and 39.

The cold air supply device may include a compressor (not shown) that compresses a gaseous refrigerant to high temperature and high pressure, a condenser (not shown) that releases heat to cause the high temperature and high pressure gas to liquefy as it passes through, an expansion device (not shown) that allows the low temperature and high pressure liquid refrigerant to pass through and become less pressurized, an evaporator (not shown) that allows the low temperature and low pressure liquid refrigerant to evaporate and generate cold air, and a blowing fan (not shown) that causes the cold air generated in the evaporator to flow.

The inner cases 20 and 30 may include a first inner case 20 and a second inner case 30. The first inner case 20 and the second inner case 30 may each be manufactured separately and then assembled together. The first inner case 20 and the second inner case 30 may each have a box shape with an open front side.

The first storage compartment 29 may be formed within the first inner case 20, and the second storage compartment 39 may be formed within the second inner case 30. The first storage compartment 29 may be used as a refrigerator room and the second storage compartment 39 may be used as a freezing room. The second storage compartment 39 may be divided into a plurality of partitions by a vertical partition 15. The vertical partition 15 may be manufactured separately from the second inner case 30 and may be coupled to the second inner case 30. However, the division and use of the storage compartments 29 and 39 as described above may be only an example and is not limited thereto.

The first inner case 20 may be located on an upper portion of the main body 10, and the second inner case 30 may be located on a lower portion of the main body 10. However, the positions of the first inner case 20 and the second inner case 30 are not limited to the present embodiment, and the first inner case 20 and the second inner case 30 may be arranged in a left-to-right direction.

The interior of the storage compartments 29 and 39 may be provided with shelves 13 on which food items can be placed, and storage containers 14 for storing the food items.

The first storage compartment 29 may be opened or closed by a pair of doors 2 and 3. The doors 2 and 3 may be rotatably coupled to the main body 10. One of the doors 2 and 3 may be provided with a rotating bar 8 that covers a space between the doors 2 and 3 when the doors 2 and 3 are closed. The rotating bar 8 may be rotatably coupled to the door 2. The rotating bar 8 may be rotatable between a closed position positioned approximately parallel to the door 2 to cover the space between the doors 2 and 3, and a movable position positioned approximately perpendicular to the door 2 to be movable without interfering with the door 3. A rotating bar protrusion 9 may be provided at one end of the rotating bar 8, and a rotation guide 59 into which the rotating bar protrusion 9 may be inserted may be provided in the main body 10. The rotation guide 59 may guide the rotating bar projection 9 to rotate in accordance with an opening angle of the door 2. Accordingly, the rotating bar 8 may be rotated depending on the opening angle of the door 2.

The second storage compartment 39 may be opened or closed by doors 4 and 5, and the doors 4 and 5 may be rotatably coupled to the main body 10. Door shelves 6 for storing food items may be provided on a rear surface of the doors 2, 3, 4, and 5. A gasket 7 that is in close contact with a front surface of the main body 10 may be provided on a rear edge of the doors 2, 3, 4, and 5 to seal the storage compartments 29 and 39.

The outer case 11 may include an outer case body 11*a* forming an upper surface and two side surfaces of the outer case 11, an outer case rear plate 11*b* coupled to the outer case body 11*a* to form a rear surface of the outer case 11, an intermediate front plate 11*c* coupled to an intermediate connecting plate M, and a vertical front plate 11*d* disposed on a front side of the vertical partition 15.

A structure of the first inner case 20 and the second inner case 30 will be described in detail below. Since there is substantially no significant difference in the structures of the first inner case 20 and the second inner case 30, the first inner case 20 may be described and the description of the second inner case 30 may be omitted. The following description of the first inner case 20 may also be equally applied to the second inner case 30.

The first inner case 20 may include a plurality of plates 21, 22, 23, 24, and 25. The first inner case 20 may be formed by combining the plurality of plates 21, 22, 23, 24, and 25. The plurality of plates 21, 22, 23, 24, and 25 may be joined together without separate fasteners.

The plurality of plates 21, 22, 23, 24, and 25 may each be formed from a resin material by an injection molding method. The plurality of plates 21, 22, 23, 24, and 25 may include an upper plate 21, a lower plate 22, a left plate 23, a right plate 24, and a rear plate 25. The upper plate 21 may form an upper side of the storage compartment 29. The lower plate 22 may form a lower side of the storage compartment 29. The left plate 23 may form a left side of the storage compartment 29. The right plate 24 may form a right side of the storage compartment 29. The rear plate 25 may form a rear side of the storage compartment 29.

However, in contrast to the present embodiment, at least two adjacent plates of the upper plate 21, the lower plate 22, the left plate 23, the right plate 24, and the rear plate 25 may be formed integrally. In other words, the first inner case 20 may not be formed of the five parts of the upper plate 21, the lower plate 22, the left plate 23, the right plate 24, and the rear plate 25, but may be formed of fewer parts.

For example, the upper plate 21 and the right plate 24 may be injection molded as a single piece, and the lower plate 22 and the left plate 23 may be injection molded as a single piece. Alternatively, the upper plate 21 and the left plate 23 may be injection molded integrally, and the lower plate 22 and the right plate 24 may be injection molded integrally.

When the first inner case 20 is formed of fewer parts rather than the five parts of the upper plate 21, the lower plate 22, the left plate 23, the right plate 24, and the rear plate 25, the following description may still be applicable.

A rail 27 may be formed on inner surfaces of the left plate 23 and the right plate 24 to slidably support the storage container 14. An evaporator fixing portion 28 for fixing the evaporator may be formed on an inner surface of the rear plate 25.

Each of the plurality of plates 21, 22, 23, 24, and 25 may have four edges.

The upper plate 21 may include a left edge 21*a*, a right edge 21*b*, a front edge 21*c*, and a rear edge 21*d*.

The lower plate 22 may include a left edge 22*a*, a right edge 22*b*, a front edge 22*c*, and a rear edge 22*d*.

The left plate 23 may include an upper edge 23*a*, a lower edge 23*b*, a front edge 23*c*, and a rear edge 23*d*.

The right plate 24 may include an upper edge 24*a*, a lower edge 24*b*, a front edge 24*c*, and a rear edge 24*d*.

The rear plate 25 may include an upper edge 25*a*, a lower edge 25*b*, a left edge 25*c*, and a right edge 25*d*.

The left edge 21*a* of the upper plate 21 and the upper edge 23*a* of the left plate 23 may be coupled.

The right edge 21*b* of the upper plate 21 and the upper edge 24*a* of the right plate 24 may be coupled.

The rear edge 21*d* of the upper plate 21 and the upper edge 25*a* of the rear plate 25 may be coupled.

The left edge 22*a* of the lower plate 22 and the lower edge 23*b* of the left plate 23 may be coupled.

The right edge 22*b* of the lower plate 22 and the lower edge 24*b* of the right plate 24 may be coupled.

The rear edge 22*d* of the lower plate 22 and the lower edge 25*b* of the rear plate 25 may be coupled.

The rear edge 23*d* of the left plate 23 and the left edge 25*c* of the rear plate 25 may be coupled.

The rear edge 24*d* of the right plate 24 and the right edge 25*d* of the rear plate 25 may be coupled.

As described above, the first inner case 20 may be formed by coupling the edges of the five plates 21, 22, 23, 24, and 25, and may have eight coupling points. The edges of the coupling points may be provided with coupling portions for mutual coupling. The respective coupling portions may include a fitting structure or a locking structure.

The front edge 21*c* of the upper plate 21, the front edge 23*c* of the left plate 23, and the front edge 24*c* of the right plate 24 may each have a front flange F forming a front surface of the first inner case 20. The rotation guide 59 that guides the rotation of the rotating bar 8 may be provided at approximately the center of the front flange F. The rotation guide 69 may be injection molded integrally with the front flange F.

The intermediate connecting plate M coupled to the front edge of the upper plate 31 of the second inner case 30 may be formed on the front edge 22*c* of the lower plate 22. An extension panel E may extend downwardly from the lower edge 23*b* of the left plate 23. The extension panel E may be coupled to the left plate of the second inner case 30. The extension panel E may prevent deformation of the inner cases 20 and 30 and the outer case 11 due to a difference in insulation thickness between the first inner case 20 and the outer case 11 and between the second inner case 30 and the outer case 11.

The second inner case 30 may include a plurality of plates 31, 32, 33, 34, and 35. The second inner case 30 may be formed by joining the plurality of plates 31, 32, 33, 34, and 35. The plurality of plates 31, 32, 33, 34, and 35 may be coupled to each other without separate fasteners.

The outer case 11 may be coupled to the front flange F of the inner cases 20 and 30. In particular, a front end of the outer case body 11*a* and the front flange F of the inner cases 20 and 30 may be coupled. The front end of the outer case body 11*a* and the front flange F of the inner cases 20 and 30 may be coupled in an elastic fitting manner.

After the front end of the outer case body 11*a* and the front flange F of the inner cases 20 and 30 are coupled in an elastic fitting manner, the outer case rear plate 11*b* and a bottom plate (not shown) may be coupled to a rear end and a lower end of the outer case body 11*a*, respectively. After the coupling of the outer case body 11*a*, the outer case rear plate 11*b*, and the bottom plate is completed, the insulation 12 may be foamed between the inner outer cases 20 and 30 and the outer case 11. After the insulation 12 is foamed and cured between the inner cases 20 and 30 and the outer case 11, the assembly of the inner cases 20 and 30 and the outer case 11 may be completed.

The specific coupling structure of the front end of the outer case body 11*a* and the front flanges F of the inner cases 20 and 30 will be described later.

Figure 4:
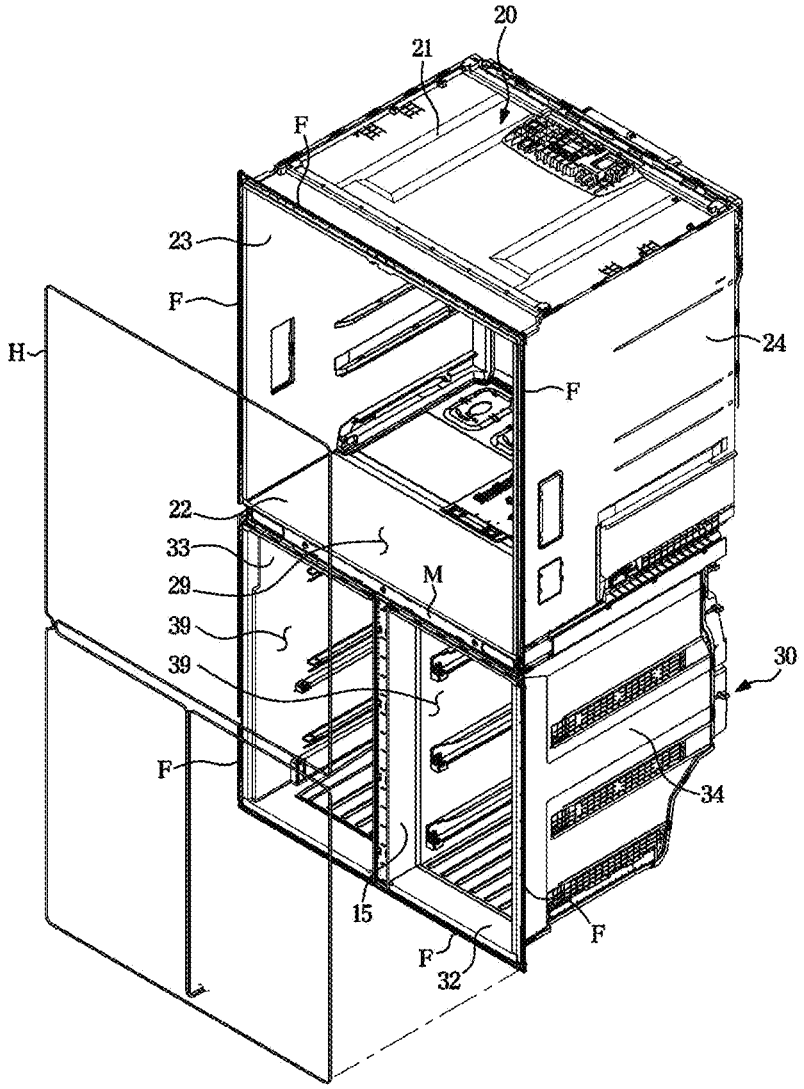
FIG. 4 is a view illustrating a mounting structure of a hot pipe according to an embodiment of the present disclosure.

FIG. 4 is a view showing a mounting structure of a hot pipe according to an embodiment of the present disclosure.

The refrigerator 1 may include a hot pipe H through which a hot refrigerant passes. The hot pipe H may be a part of a refrigerant pipe connecting the evaporator (not shown) and the condenser (not shown), or may be a part of a refrigerant pipe connecting the condenser (not shown) and the expansion device (not shown).

The hot pipe H may have a hot refrigerant flowing therein, which may cause a surface of the hot pipe H to have a high temperature. The hot pipe H may be disposed on the front surface of the main body 10 to prevent dew condensation from forming on the surface of the main body 10 due to a temperature difference between the inside and outside of the main body 10.

In particular, the hot pipe H may be disposed on the front surface of the front flange F. To this end, the front flange F may have a mounting groove 65 (FIG. 6) formed to allow the hot pipe H to be mounted.

In addition, the hot pipe H may be disposed on the intermediate connecting plate M between the first storage compartment 29 and the second storage compartment 39 and the vertical partition 15 between the plurality of second storage compartments 39.

Figure 5:
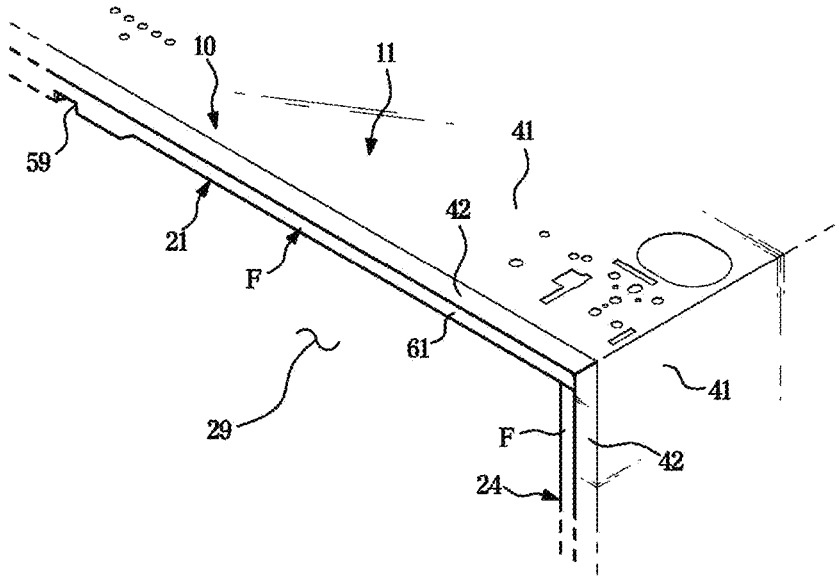
FIG. 5 is a view illustrating a portion of a main body of the refrigerator according to an embodiment of the present disclosure.
Figure 6:
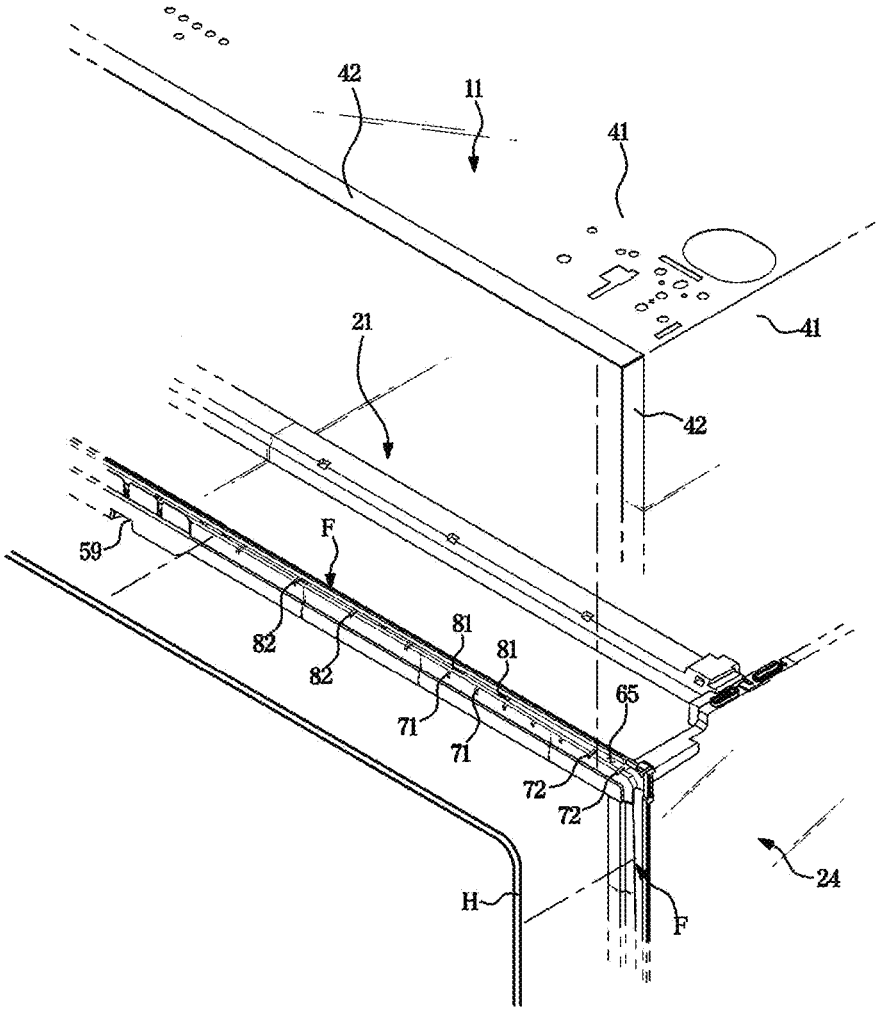
FIG. 6 is a view illustrating a coupled structure of the inner case, the outer case, and the hot pipe according to an embodiment of the present disclosure.
Figure 7:
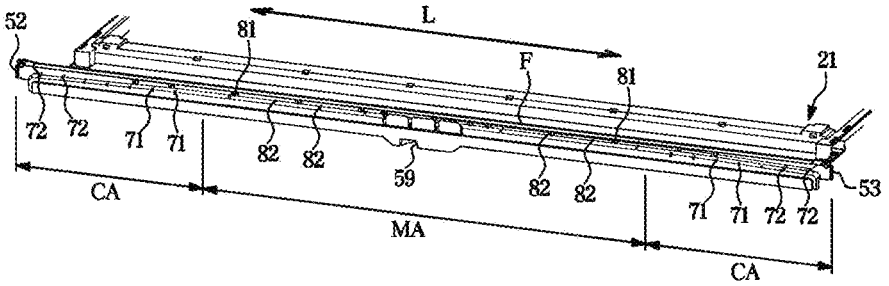
FIG. 7 is a view illustrating a front flange of an upper plate according to an embodiment of the present disclosure.
Figure 8:
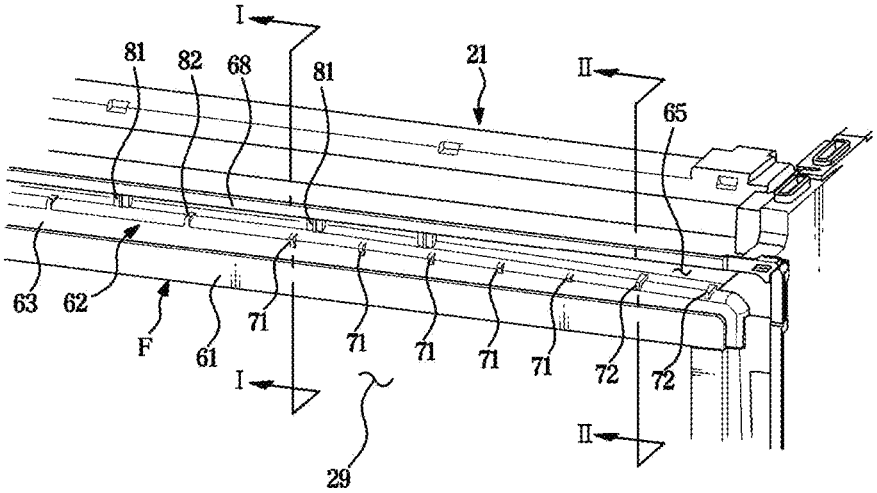
FIG. 8 is an enlarged perspective view of a portion of the front flange of the upper plate according to an embodiment of the present disclosure.
Figure 9:
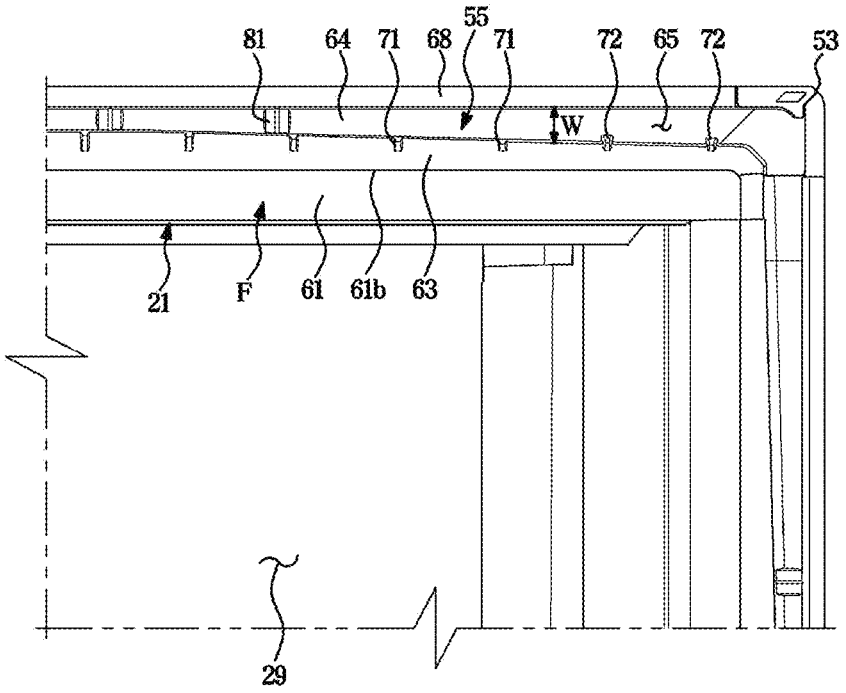
FIG. 9 is an enlarged front view of a portion of the front flange of the upper plate according to an embodiment of the present disclosure.
Figure 10:
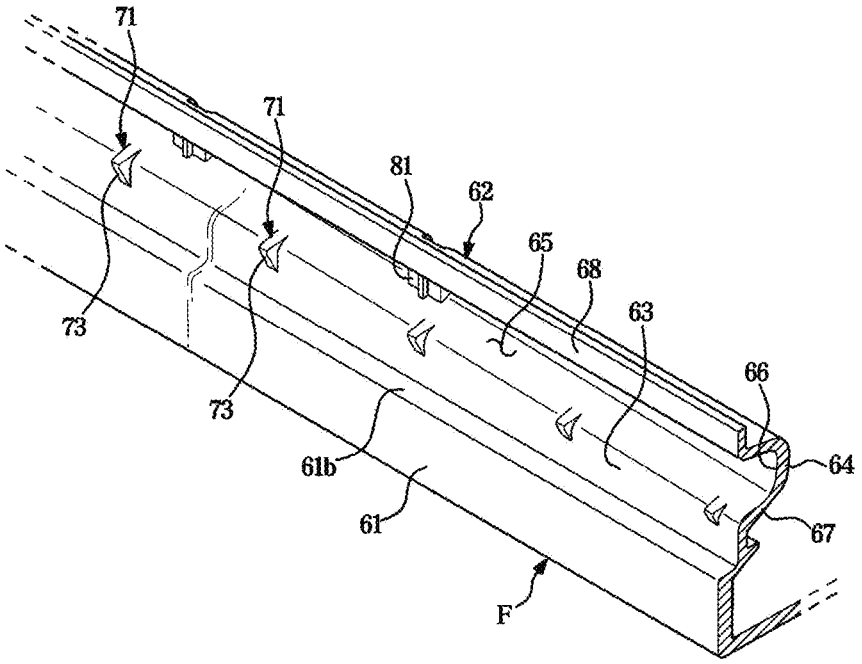
FIG. 10 is a view illustrating an outer locking rib according to an embodiment of the present disclosure.
Figure 11:
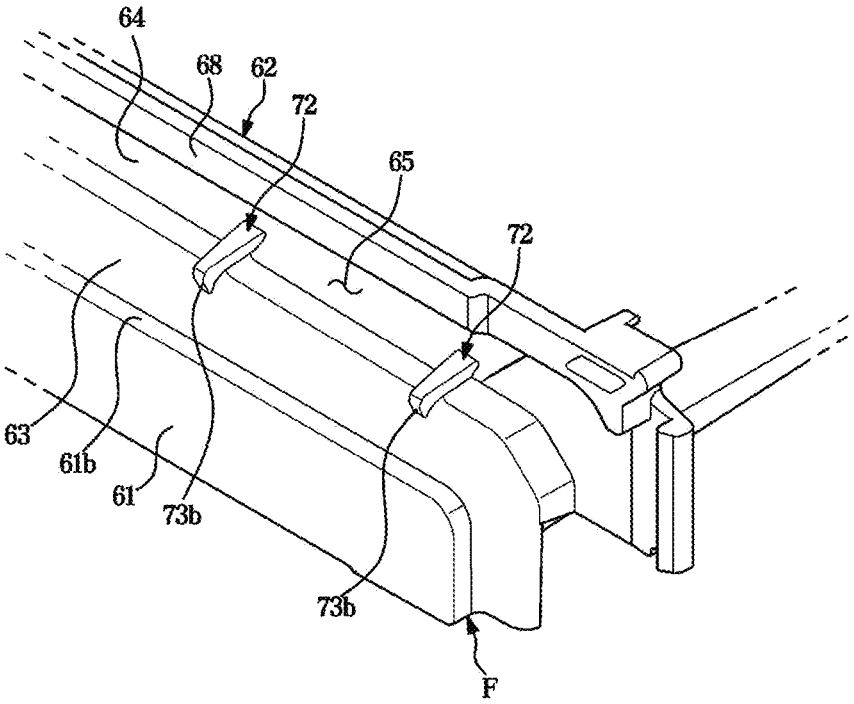
FIG. 11 is a view illustrating an extended locking rib according to an embodiment of the present disclosure.
Figure 12:
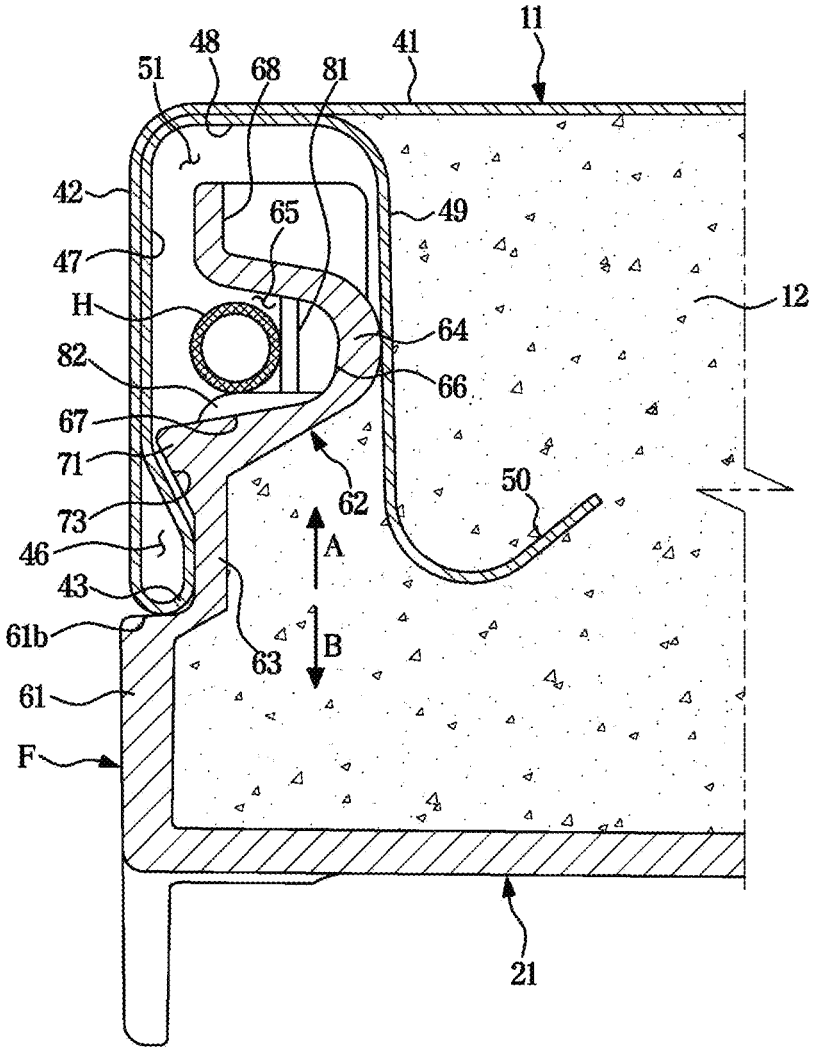
FIG. 12 is a cross-sectional view taken along the line I-I of FIG. 8 (also showing the outer case and the hot pipe).
Figure 13:
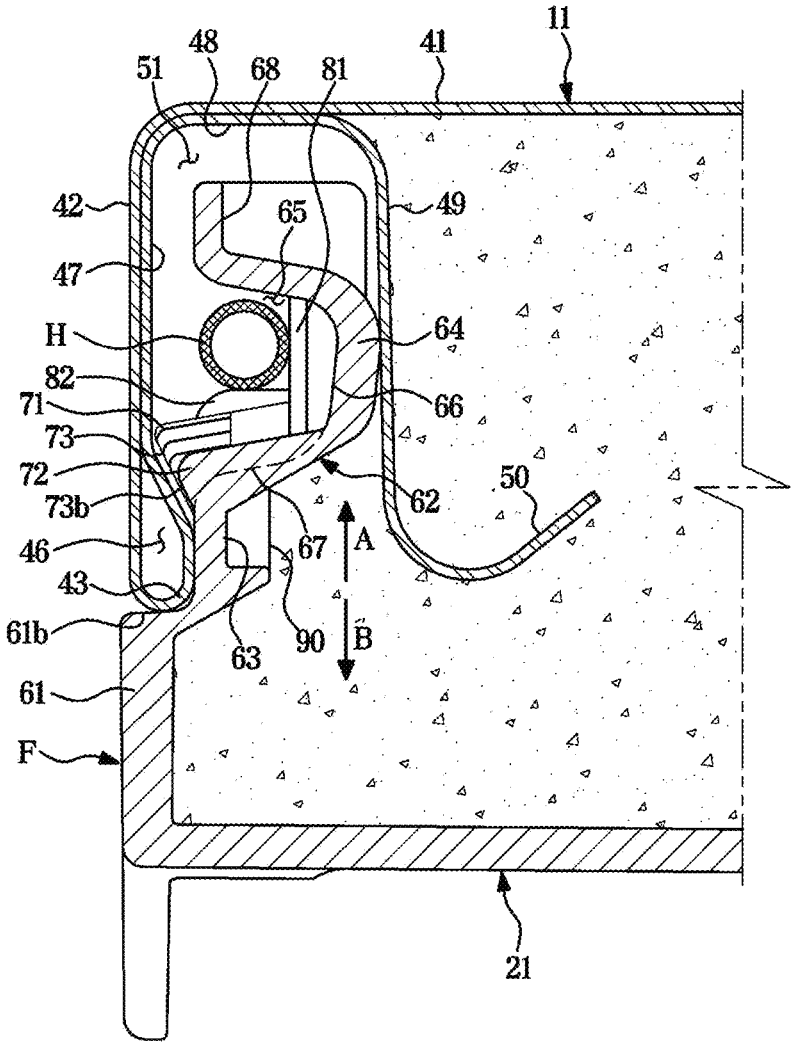
FIG. 13 is a cross-sectional view taken along the line II-II of FIG. 8 (also showing the outer case and the hot pipe).

FIG. 5 is a view illustrating a portion of the main body of the refrigerator according to an embodiment of the present disclosure. FIG. 6 is a view illustrating a coupled structure of the inner case, the outer case, and the hot pipe according to an embodiment of the present disclosure. FIG. 7 is a view illustrating the front flange of the upper plate according to an embodiment of the present disclosure. FIG. 8 is an enlarged perspective view of a portion of the front flange of the upper plate according to an embodiment of the present disclosure. FIG. 9 is an enlarged front view of a portion of the front flange of the upper plate according to an embodiment of the present disclosure. FIG. 10 is a view illustrating an outer locking rib according to an embodiment of the present disclosure. FIG. 11 is a view illustrating an extended locking rib according to an embodiment of the present disclosure. FIG. 12 is a cross-sectional view taken along the line I-I of FIG. 8 (also showing the outer case and the hot pipe). FIG. 13 is a cross-sectional view taken along the line II-II of FIG. 8 (also showing the outer case and the hot pipe).

Hereinafter, a coupling structure of the front flange F of the upper plate 21 and the outer case 11 will be described with reference to FIGS. 5 to 13. The coupling structure of the front flange F of the upper plate 21 and the outer case 11 may be equally applicable to the coupling structure of the front flange F of other plates and the outer case 11, and a description thereof will be omitted.

The outer case 11 may be formed by roll forming or the like from an iron plate material, and an insertion groove 51 (see FIG. 12) into which the front flange F is inserted may be formed at the front end of the outer case 11.

As shown in FIGS. 12 and 13, the outer case 11 may include an outer portion 41 forming an outer surface of the main body 10, a front portion 42 forming the front surface of the main body 10, a bending support portion 43 formed to be bent to be supported on the front flanges F of the inner cases 20 and 30, a first overlapping portion 47 and a second overlapping portion 48 formed to overlap the front portion 42 and the outer portion 41, respectively, an elastic portion 49 elastically pressing the front flanges F of the inner cases 20 and 30, and a tail portion 50 extending from the elastic portion 49. An elastic space 46 may be formed inside the bending support portion 43 to allow elastic deformation of the bending support portion 43. The outer portion 41, the front portion 42, the bending support portion 43, the first overlapping portion 47, the second overlapping portion 48, the elastic portion 49, and the tail portion 50 may be formed by bending as a unit.

The insertion groove 51 into which the front flange F is inserted may be formed by the bending support portion 43, the first overlapping portion 47, the second overlapping portion 48, and the elastic portion 49.

When the front flange F and the outer case 11 are coupled, the front flange F may be inserted into the insertion groove 51 along an insertion direction A as the elastic portion 49 is widened. After the front flange F is inserted into the insertion groove 51, the insulation 12 including urethane may be foamed between the inner cases 20 and 30 and the outer case 11. After the foamed insulation 12 has cured, the outer case 11 may be secured by the insulation 12, so that the front flange F may be secured while being inserted into the insertion groove 51.

The front flange F may include a base portion 61 disposed on an outer side of the insertion groove 51 and exposed forwardly, and an insertion portion 62 extending from the base portion 61 to be inserted into the insertion groove 51. A front surface of the base portion 61 may be located on the same plane as a front surface of the front portion 42 of the outer case 11. The front surface of the base portion 61 may form the front surface of the main body 10 together with the front surface of the front portion 42 of the outer case 11.

The insertion portion 62 may be inserted into the insertion groove 51 of the outer case 11, so that it may be covered by the outer case 11 and may not be exposed to the front. The insertion portion 62 may include an insertion body 63 corresponding to the bending support portion 43 of the outer case 11, an insertion end 68 forming an end of the front flange F, and a groove forming portion 64 arranged between the insertion body 63 and the insertion end 68 to form the mounting groove 65 to which the hot pipe H is mounted. The groove forming portion 64 may protrude rearwardly between the insertion body 63 and the insertion end 68.

The base portion 61 and the insertion body 63 may be formed to have a step, and the bending support portion 43 of the outer case 11 may be disposed in the stepped space of the base portion 61 and the insertion body 63. The bending support portion 43 may be supported on a stepped surface 61*b* of the base portion 61 and a front surface of the insertion body 63.

The front flange F may include a plurality of locking ribs 71 and 72 arranged to prevent the front flange F from moving in a direction B, which is opposite to the insertion direction A, in a state where the front flange F is inserted into the insertion groove 51. In other words, the plurality of locking ribs 71 and 72 may function to prevent a space between the stepped surface 61*b* of the front flange F and the bending support portion 43 of the outer case 11 from widening. In another aspect, the plurality of locking ribs 71 and 72 may function to guide the position of the bending support portion 43 when the front flange F and the outer case 11 are coupled.

The plurality of locking ribs 71 and 72 may be injection molded integrally with the upper plate 21 during the formation of the upper plate 21. The plurality of locking ribs 71 and 72 may be formed to be spaced apart from each other along a longitudinal direction L (see FIG. 7) of the front flange F.

According to the injection molding method, the plurality of locking ribs 71 and 72 may be precisely formed in the required number at the required position. In other words, the plurality of locking ribs 71 and 72 may not be formed over the entire area of the front flange F. Since the plurality of locking ribs 71 and 72 may act as resistance in the process of inserting the front flange F into the insertion groove 51 of the outer case 11, it may be desirable from the viewpoint of ease of assembly that the number of the locking ribs 71 and 12 be minimized insofar as the fixing force of the front flange F and the outer case 11 is maintained.

The locking ribs 71 and 72 may include locking surfaces 73 and 73*b* (see FIGS. 10 to 13) on which the outer case 11 is arranged to be locked. In particular, the locking surfaces 73 and 73*b* may be arranged to be locked on the bending support portion 43 of the outer case 11.

The locking surfaces 73 and 73*b* may be formed to be inclined in the insertion body 63. In particular, the locking surfaces 73 and 73*b* may be formed to be inclined to extend forward in the insertion direction A of the front flange F.

Referring to FIG. 7, according to an embodiment of the present disclosure, the locking ribs 71 and 72 may not be formed in the entire area of the front flange F, but may be formed only in some areas. In particular, the locking ribs 71 and 72 may be formed in corner areas CA excluding in a central area MA of the front flange F. The corner areas CA may be areas adjacent to both longitudinal ends 52 and 53 of the front flange F.

By forming the plurality of locking ribs 71 and 72 in the corner areas CA of the front flange F, the number of the plurality of locking ribs 71 and 72 may be minimized and the front flange F and the outer case 11 may be sufficiently fixed.

Furthermore, since the storage compartment 29 is maintained at a low temperature, thermal shrinkage deformation may occur in the plates forming the inner case 20. In this case, the fixing force of the front flange F and the outer case 11 in the corner areas CA may be weakened. Accordingly, the provision of the locking ribs 71 and 72 in the corner areas CA may effectively prevent a gap or step between the front flange F and the outer case 11 from occurring.

However, in contrast to the present embodiment, the locking ribs 71 and 72 may be formed in the central area MA excluding the corner areas CA of the front flange F and may be uniformly formed along the longitudinal direction of the front flange F.

Although the locking ribs 71 and 72 formed on the front flange F of the upper plate 21 of the first inner case 20 have been described above, the locking ribs 71 and 72 may also be formed on the front flange F of other plates of the first inner case 20, and may also be formed on the front flange F of the plates of the second inner case 30.

The plurality of locking ribs 71 and 72 may be formed adjacent to one side of the mounting groove 65. In particular, the plurality of locking ribs 71 and 72 may be formed adjacent to one side of the mounting groove 65 facing the storage compartment 29. In other words, the plurality of locking ribs 71 and 72 may protrude from the insertion body 63 of the front flange F.

Some of the plurality of locking ribs 71 and 72 may be formed on the outside of the mounting groove 65. Others of the plurality of locking ribs 71 and 72 may be formed to extend between the outside of the mounting groove 65 and the inside of the mounting groove 65. That is, the plurality of locking ribs 71 and 72 may include an outer locking rib 71 formed on the outside of the mounting groove 65 and an extended locking rib 72 formed to extend between the outside of the mounting groove 65 and the inside of the mounting groove 65. However, in contrast to the present embodiment, the front flange F may include only the outer locking rib 71 formed on the outside of the mounting groove 65, or only the extended locking rib 72 extending from the outside of the mounting groove 65 to the inside of the mounting groove 65.

As such, the outer locking rib 71 and the extended locking rib 72 may be distinguished based on their positions relative to the mounting groove 65. In addition, since the extended locking rib 72 is formed longer than the outer locking rib 71, the outer locking rib 71 and the extended locking rib 72 may be distinguished based on their shapes.

However, based on the stepped surface 61*b* of the front flange F, the locking surface 73 of the outer locking rib 71 and the locking surface 73*b* of the extended locking rib 72 may be formed in a corresponding shape at a position corresponding to each other. In other words, when the locking surface 73 of the outer locking rib 71 and the locking surface 73*b* of the extended locking rib 72 are viewed in the longitudinal direction L of the front flange F, the locking surface 73 of the outer locking rib 71 and the locking surface 73*b* of the extended locking rib 72 may be arranged to overlap each other at least partially (see FIG. 13). This is because the shape of the outer case 11 is the same along the longitudinal direction L of the front flange F.

The front flange F may include the mounting groove 65 formed along the longitudinal direction L of the front flange F to which the hot pipe H is mounted. The mounting groove 65 may be formed such that a width W of the mounting groove 65 gradually increases toward the both longitudinal ends 52 and 53 of the front flange F. In other words, the front flange F may include expansion areas 55 in which the width W of the mounting groove 65 gradually increases toward the both longitudinal ends 52 and 53 of the front flange F.

As such, the front flange F having the expansion areas 55 may allow the hot pipe H to be easily mounted in the mounting groove 65 of the front flange F.

In response to the width W of the mounting groove 65 widening toward the first end 53 of the front flange F, the width of the insertion body 63 of the front flange F may narrow toward the first end 53 of the front flange F. As a result, of the extended locking rib 72 and the outer locking rib 71, the extended locking rib 72 may be located closer to the first end 53 of the front flange F.

The locking ribs 71 and 72 may be spaced apart from the hot pipe H mounted in the mounting groove 65.

The front flange F may include support ribs 81 and 82 formed on the interior of the mounting groove 65 to support the hot pipe H. The support ribs 81 and 82 may be provided separately from the locking ribs 71 and 72. The support ribs 81 and 82 may cause the hot pipe H to be brought into close contact with the outer case 11 side or cause the contact area between the hot pipe H to be minimized, thereby inducing the heat of the hot pipe H to be transferred to the outer case 11 and causing the heat of the hot pipe H to be prevented from being transferred to the inner case 20.

The support ribs 81 and 82 may include a bottom support rib 81 formed on a bottom surface 66 of the mounting groove 65, and a side support rib 82 formed on a side surface 67 of the mounting groove 65.

The bottom support rib 81 may bring the hot pipe H into close contact with the outer case 11 side and reduce the contact area between the hot pipe H and the front flange F. The bottom support rib 81 may be formed uniformly along the longitudinal direction of the front flange F.

The side support rib 82 may be formed on the side surface 67 closer to the storage compartment 29 of the side surfaces of the mounting groove 65. The side support ribs 82 may reduce the contact area of the hot pipe H and the front flange F. As described above, the width W of the mounting groove 65 increases toward the both ends 52 and 53 of the front flange F, so that the hot pipe H and the side surface 67 closer to the storage compartment 29 of the mounting groove 65 may widen toward the both ends 52 and 53 of the front flange F.

Accordingly, the side support ribs 82 may be unnecessary in the corner areas CA, and the side support ribs 82 may be formed in the central area MA excluding the corner areas CA.

Figure 14:
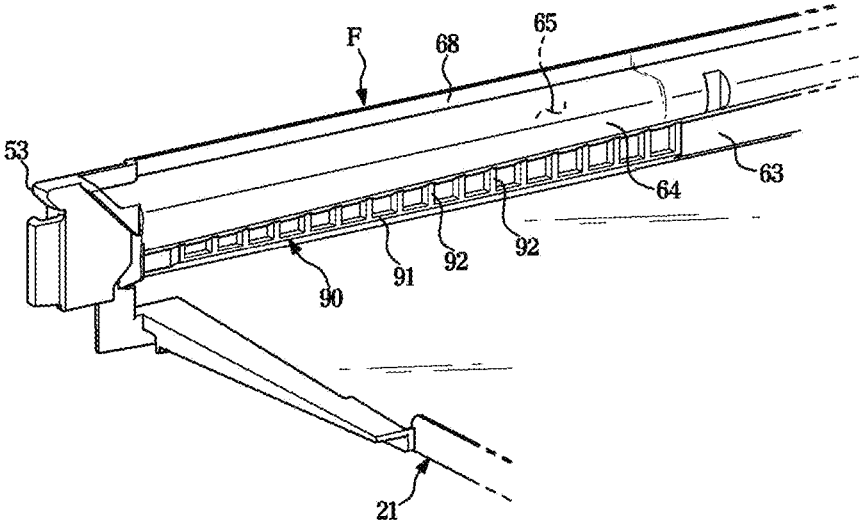
FIG. 14 is a back view of the front flange of the upper plate according to an embodiment of the present disclosure.

FIG. 14 is a view showing a rear surface of the front flange of the upper plate according to an embodiment of the present disclosure.

Referring to FIG. 14, the front flange F may include a reinforcing rib 90 formed on a lower side of the groove forming portion 64 on the rear surface of the front flange F. The groove forming portion 64 may have a convex shape rearwardly to form the mounting groove 65, and the reinforcing rib 90 may add strength to the groove forming portion 64 and the front flange F to prevent deformation.

The reinforcing rib 90 may be injection molded integrally with the front flange F. The reinforcing rib 90 may not be formed in the entire area along the longitudinal direction L of the front flange F, but may be formed only in a portion of the area on the corner side.

The reinforcing rib 90 may include a horizontal reinforcing rib 91 extending in a horizontal direction, and vertical reinforcing ribs 92 extending perpendicular to the horizontal reinforcing rib 91 between the horizontal reinforcing rib 91 and the groove forming portion 64. The vertical reinforcing ribs 92 may be provided in a plurality and spaced apart from each other along the longitudinal direction L of the front flange F.

Since the height of a lower end of the groove forming portion 64 decreases toward the both ends 52 and 53 of the front flange F, the plurality of vertical reinforcing ribs 92 may decrease in height toward the both ends 52 and 53 of the front flange F.

While the present disclosure has been particularly described with reference to exemplary embodiments, it should be understood by those of skilled in the art that various changes in form and details may be made without departing from the spirit and scope of the present disclosure.

What is claimed is:

1. A refrigerator comprising:

a main body including:

an inner case that forms a storage compartment having an open front, the inner case including a plurality of plates each formed by injection molding; and an outer case coupled to an outer side of the inner case;

an insulation disposed between the inner case and the outer case;

a hot pipe through which a hot refrigerant pass; and a door coupled to the main body to open or close the storage compartment, wherein at least one of the plurality of plates includes a front flange forming a front surface thereof and coupled to the outer case, the outer case includes an insertion groove into which the front flange is inserted, the front flange includes;

a mounting groove formed along a longitudinal direction of the front flange to mount the hot pipe to the mounting groove;

an expansion area in which a width of the mounting groove gradually widens toward one end of the front flange in the longitudinal direction; and a plurality of locking ribs formed adjacent to one side of the mounting groove, and arranged to prevent the front flange from moving in a direction opposite to an insertion direction of the front flange based on inserting the front flange into the insertion groove, the plurality of locking ribs is injection molded integrally with the at least one of the plurality of plates, and the plurality of locking ribs protrudes from the front flange so as to be locked on the outer case, and are spaced apart from each other along the longitudinal direction of the front flange.

2. The refrigerator of claim 1, wherein the plurality of locking ribs is formed in corner areas adjacent to both ends of the front flange in the longitudinal direction, excluding a central area of the front flange.

3. The refrigerator of claim 1, wherein the plurality of locking ribs includes a locking surface formed to lock the outer case, and the locking surface is inclined to extend forwardly in the insertion direction.

4. The refrigerator of claim 1, wherein the front flange includes a base portion exposed forwardly to form a portion of a front surface of the main body, and an insertion portion extending from the base portion to be inserted into the insertion groove, the plurality of locking ribs is formed to protrude forwardly from the insertion portion.

5. The refrigerator of claim 1, wherein the plurality of locking ribs includes an outer locking rib formed on an outside of the mounting groove.

6. The refrigerator of claim 1, wherein the plurality of locking ribs includes an extended locking rib extending between an outside of the mounting groove and an inside of the mounting groove.

7. The refrigerator of claim 6, wherein the plurality of locking ribs includes an outer locking rib formed on an outside of the mounting groove, and wherein of the extended locking rib and the outer locking rib, the extended locking rib is located closer to the one end of the front flange.

8. The refrigerator of claim 1, wherein the plurality of locking ribs is spaced apart from the hot pipe.

9. The refrigerator of claim 1, further comprising a plurality of support ribs formed within the mounting groove to support the hot pipe.

10. The refrigerator of claim 9, wherein the plurality of locking ribs is formed separately from the plurality of support ribs and are spaced apart from the plurality of support ribs.

11. The refrigerator of claim 10, wherein the plurality of support ribs includes a bottom support rib formed on a bottom surface of the mounting groove and a side support rib formed on a side surface of the mounting groove.

12. The refrigerator of claim 1, wherein the front flange includes a groove forming portion protruding rearwardly to form a mounting groove, and a reinforcing rib disposed on a rear surface of the front flange to be connected to the groove forming portion.

13. The refrigerator of claim 12, wherein the reinforcing rib is formed in corner areas adjacent to both ends of the front flange, excluding a central area of the front flange.

* * * * *